US009325115B2

(12) United States Patent
Zhang et al.

(10) Patent No.: US 9,325,115 B2
(45) Date of Patent: Apr. 26, 2016

(54) ELECTRICAL CONNECTOR

(71) Applicant: Drapho Electronics Technology Co., Ltd., Kunshan, Jiangsu (CN)

(72) Inventors: Ming Zhang, Jiangsu (CN); Zhihong Fang, Jiangsu (CN); Zhuping Wu, Jiangsu (CN)

(73) Assignee: DRAPHO ELECTRONICS TECHNOLOGY CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 14/226,330

(22) Filed: Mar. 26, 2014

(65) Prior Publication Data

US 2014/0295693 A1 Oct. 2, 2014

(30) Foreign Application Priority Data

Mar. 29, 2013 (CN) ..... 2013 2 0153379 U

(51) Int. Cl.

| | |
|---|---|
| ***H01R 13/64*** | (2006.01) |
| ***H01R 12/70*** | (2011.01) |
| ***H01R 24/62*** | (2011.01) |
| ***H01R 12/71*** | (2011.01) |

(52) U.S. Cl.

CPC ..... *H01R 13/64* (2013.01); *H01R 12/7088* (2013.01); *H01R 24/62* (2013.01); *H01R 12/716* (2013.01)

(58) Field of Classification Search

CPC ..... H01R 12/716; H01R 12/712; H01R 13/6658; H01R 27/07

USPC ..... 439/35, 660, 353, 374, 638, 653

See application file for complete search history.

(56) References Cited

U.S. PATENT DOCUMENTS

| | | | | |
|---|---|---|---|---|
| 7,344,414 | B2 * | 3/2008 | Kuo | 439/620.04 |
| 7,381,068 | B1 * | 6/2008 | Lin et al. | 439/136 |
| 7,430,801 | B2 * | 10/2008 | Iida et al. | 29/883 |
| 7,758,374 | B2 * | 7/2010 | Yu et al. | 439/493 |
| 8,721,353 | B2 * | 5/2014 | Xu et al. | 439/108 |
| 2005/0059296 | A1 * | 3/2005 | Wang | 439/541.5 |
| 2012/0196490 | A1 * | 8/2012 | De Blieck | H01R 43/16 439/681 |
| 2013/0309912 | A1 * | 11/2013 | Tai et al. | 439/660 |
| 2014/0194008 | A1 * | 7/2014 | Locker et al. | 439/638 |

* cited by examiner

*Primary Examiner* — Amy Cohen Johnson
*Assistant Examiner* — Oscar C Jimenez
(74) *Attorney, Agent, or Firm* — Locke Lord LLP; Tim Tingkang Xia, Esq.

(57) ABSTRACT

An electrical connector includes an insulative housing, a plurality of terminals retained in the insulative housing. The insulative housing has a receiving room and a mating part received in the receiving room, the mating part defines a mating hole and a pair of receiving grooves extending rearward on two lateral sides of the mating hole. The terminals include a detecting terminal received in the mating hole and a pair of power terminals received in the receiving grooves. The mating part further defines a pair of guiding surfaces on two sides of the mating hole and a pair of stiffening ribs on two sides of the receiving groove, which can reduce the mating force during the mating process and protect the mating part.

9 Claims, 7 Drawing Sheets

ELECTRICAL CONNECTOR

CROSS-REFERENCE TO RELATED APPLICATIONS

This application claims priority under 35 U.S.C. §119 to People's Republic of China Patent Application 201320153379.0 entitled "Electrical Connector" filed Mar. 29, 2013.

FIELD OF THE INVENTION

The present invention relates generally to electrical connection, and more particularly to electrical connectors mounted on a printed circuit board (short as "PCB").

BACKGROUND

Electrical connector is one kind of electrical components with high accuracy, which is normally used for mating with another coupled electrical connector in order to provide signal transmission, so electrical connectors are widely used in kinds of electrical connections, especially in computer, such as USB connector, D-sub connector, RJ-45 connector etc.

Usually, an electrical connector includes an insulative housing and a plurality of terminals retained in a mating portion of the insulative housing. Normally, each terminal has a tail soldered on a PCB, and there is a plurality of soldering areas corresponding to said tails so that the tails can be mounted on the PCB. Meanwhile, said mating portion mates with a coupled electrical connector to build up electrical connection therebetween. During the mating process, the mating portion will be damaged easily by mating force if mating in a wrong way, because most of the mating portion is made of insulative material with small size. Moreover, the terminals retained on said mating portion will also have risk of being damaged which may cause wrong connection.

SUMMARY OF THE INVENTION

Accordingly, an object of the present invention is to provide an electrical connector with firm structure during a mating process.

In order to achieve the object set forth, in one embodiment, an electrical connector in accordance with the present invention comprises an insulative housing having a mating room and a mating part received in said mating room, said mating part defines a mating hole and a pair of receiving grooves extending rearward on two lateral sides of said mating hole; a plurality of terminals retained in said insulative housing and including a detecting terminal received in said mating hole and a pair of power terminals received in said receiving grooves; wherein said mating part further defines a pair of guiding surfaces on two sides of said mating hole and a pair of stiffening ribs on two sides of each receiving groove.

In yet another embodiment, an electrical connector, comprising: an insulative housing having a mating room, a T-shaped first mating part and a second mating part which are both received in said mating room, said first mating part including a vertical portion and a horizontal portion, said second mating part having a mating hole; a plurality of terminals retained in said insulative housing; a shell covering on said insulative housing; a spacer engaged with said insulative housing; wherein said second mating part has a pair of slanted guiding surfaces on two lateral sides and a pair of receiving grooves behind said slanted guiding surface.

Other objects, advantages and novel features of the invention will become more apparent from the following detailed description when taken in conjunction with the accompanying drawings.

DETAILED DESCRIPTION

Figure 1:
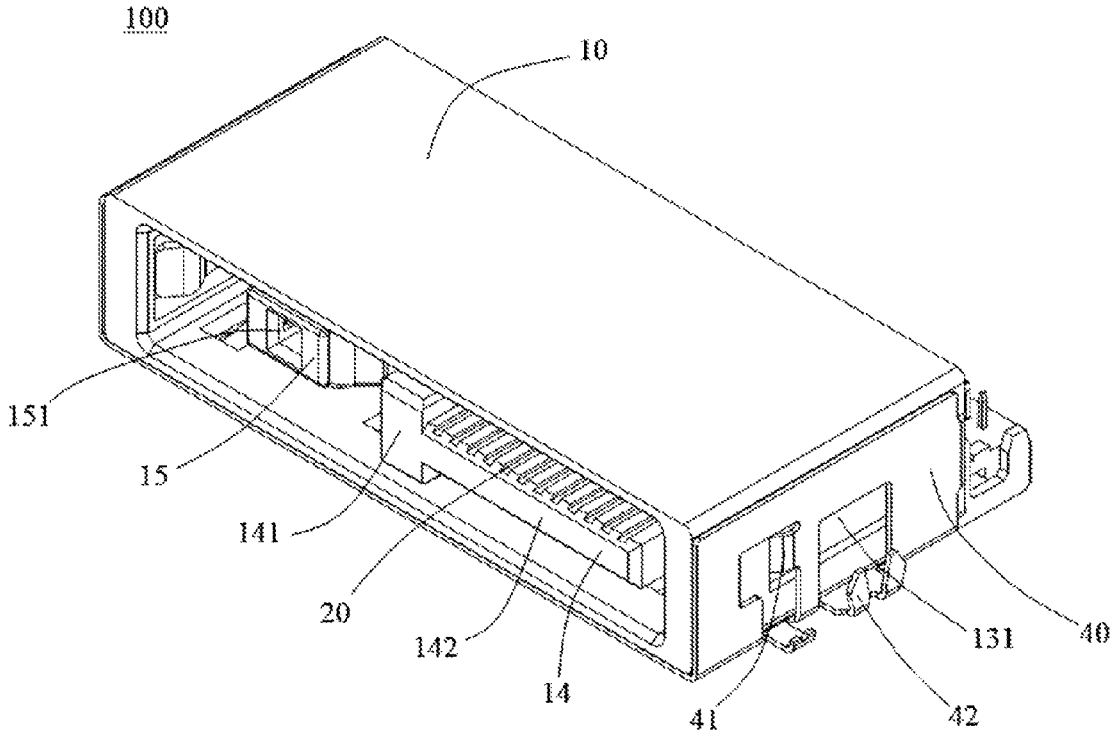
FIG. 1 is an assembled, perspective view of an electrical connector.
Figure 2:
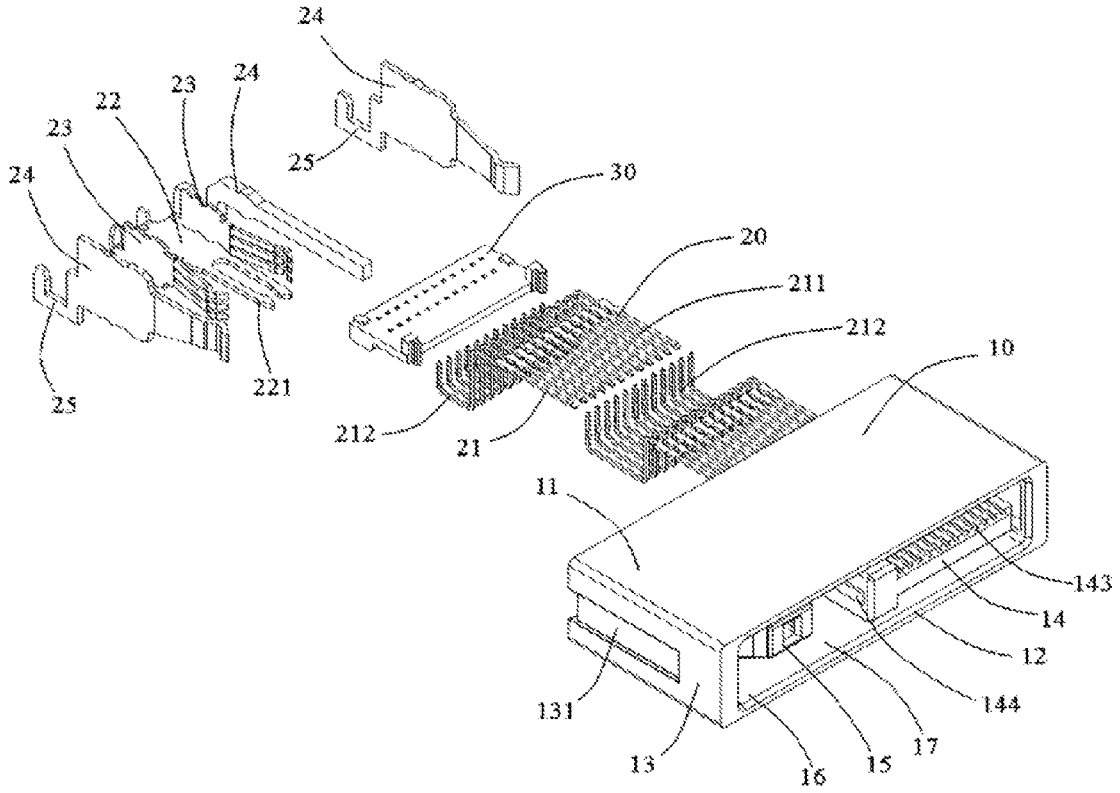
FIG. 2 is an exploded, perspective view of the electrical connector without a shell.

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

As referring to FIG. 1 to FIG. 10, the present invention provides an electrical connector 100. The electrical connector 100 includes an insulative housing 10, a plurality of terminals 20 retained in said insulative housing 10, a spacer 30 for fixing said terminals 20, and a shell 40 covered on said insulative housing 10. Said terminals 20 are soldered on a printed circuit board (short as "PCB") and also mating with a coupled connector so that the electrical connection therebetween is formed.

Figure 10:
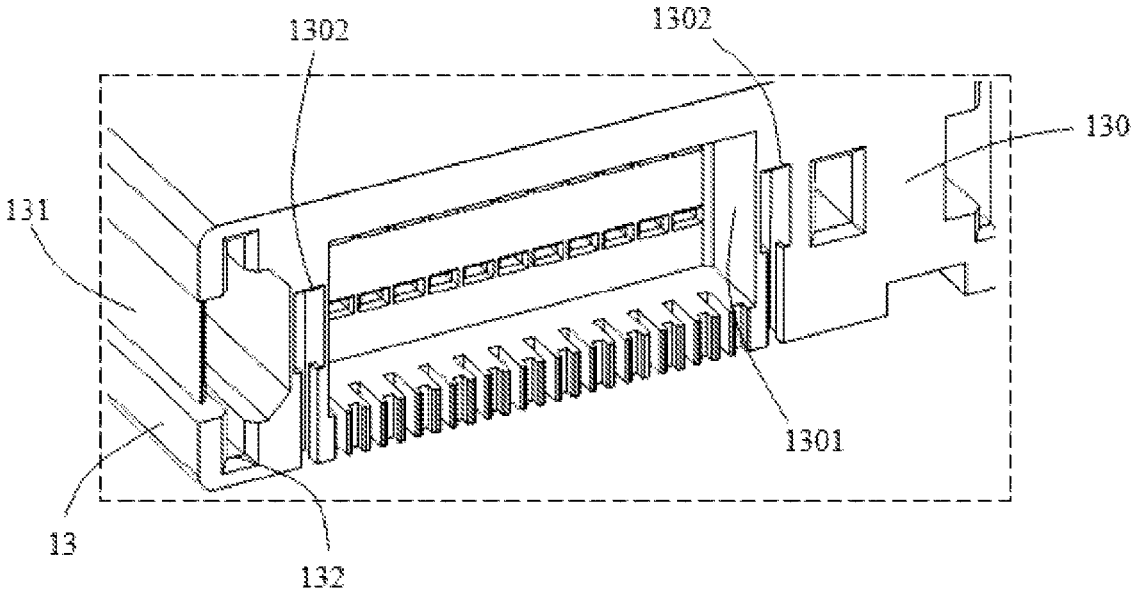
FIG. 10 is a backside perspective view of the insulative housing of the electrical connector.

Said insulative housing 10 extends longitudinally and has a top wall 11, a bottom wall 12, a pair of sidewalls 13, a rear wall 130 connecting with two sidewalls 13, and a mating portion formed between said walls. Said top wall 11, bottom wall 12, sidewalls 13 and rear wall 130 jointly define a mating room 17 and a mating port 16 for receiving said coupled connector. Additionally, the sidewall 13 has a retaining slot 131 on an outer surface thereof for retaining said shell 40, and an engaging slot 132 on an inner surface thereof. Said rear wall 130 has a notch 1301 for receiving the terminals 20 and a fixing slot 1302 located on two sides of said notch 1301, as shown in FIG. 10, said fixing slot 1302 is vertically extending and having a wider upper part and a narrower lower part which defines a T-shape for engaging with said spacer 30.

Said mating portion includes a first mating part 14 and a second mating part 15 which are both located in said mating room 17 in way of left and right arrangement. Said first mating part 14 is T-shaped with a vertical portion 141 and a horizontal portion 142, the vertical portion 141 is used for preventing wrong insertion, the horizontal portion 142 defines a plurality of passageways 143 on a top face and a bottom face for receiving said terminals 20. Said second mating part 15 is rectangular-shaped, and further defines a rectangular mating hole 151, a pair of slanted guiding surfaces 152 on two sides of said mating hole 151 and a pair of receiving grooves 153 which extends rearward through the rear wall 130 and located behind the guiding surfaces 152. Said guiding surface 152 can lead a smooth insertion for the coupled connector when the inserting direction is wrong so that the second mating part 15 may not be damaged easily by the mating force. Moreover, said rectangular mating hole 151 is located in the middle of said second mating part 15 and facing to said mating port 16, as referring to FIG. 7 and FIG. 8, said second mating part 15 further defines a pair of stiffening ribs 154 on two sides of each receiving groove 153 which configures a cross section of the second mating part 15 with a horizontal H shape. Said stiffening ribs 154 will make the second mating part 15 stronger and difficult to be broken during the mating process with the coupled connector. Furthermore, there are two lateral channels 155 on two sides said rectangular mating hole 151, said lateral channels 155 and the rectangular mating hole 151 are connected to define a cross-shaped hole.

As mentioned above, the electrical connector of the present invention provides two types of mating parts for transmitting two different types of signals. The electrical connector combines two kinds of connector which reduces the cost and the occupancy on PCB.

Said terminals 20 includes a plurality of signal terminals 21 retained on said first mating part 14, a detecting terminal 22 and a pair of power terminals 23 retained on said second mating part 15, and at least one pair of ground terminals 24 retained on two sidewalls 13 of the insulative housing 10.

Figure 3:
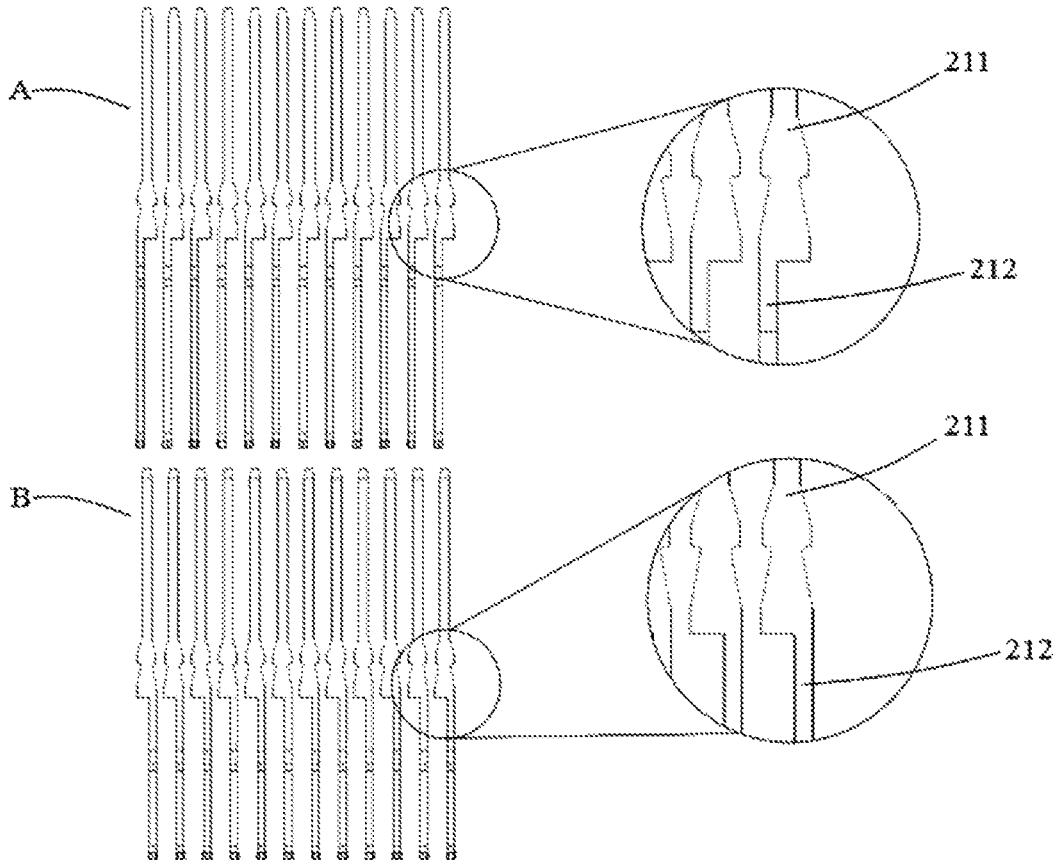
FIG. 3 is a perspective view of the terminals of the electrical connector.
Figure 4:
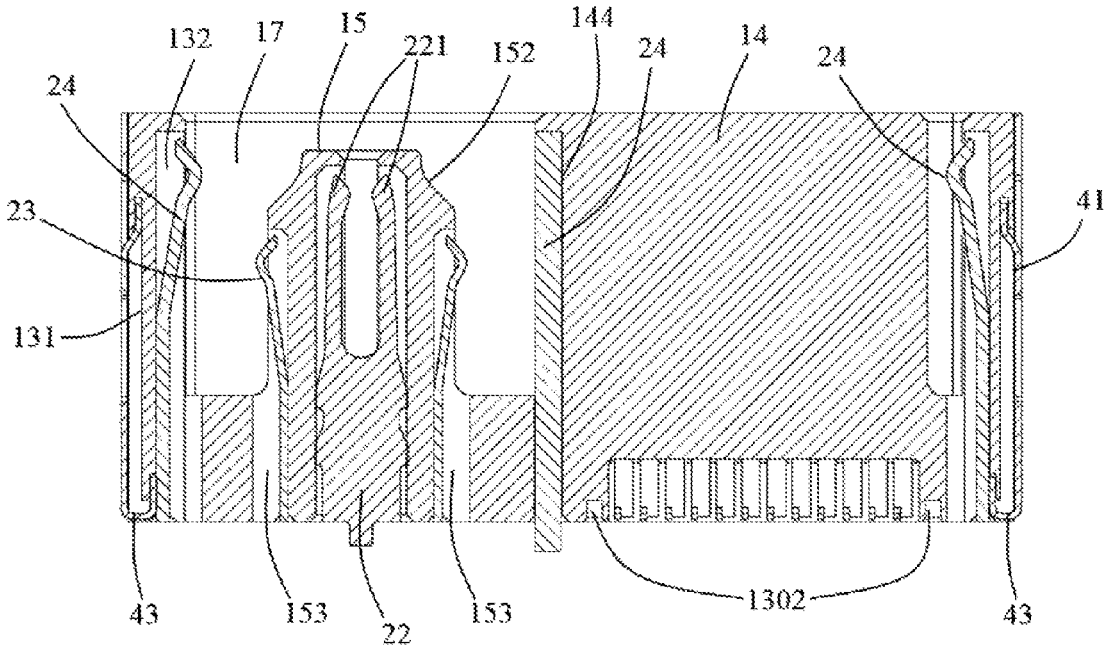
FIG. 4 is a section view of the electrical connector.
Figure 5:
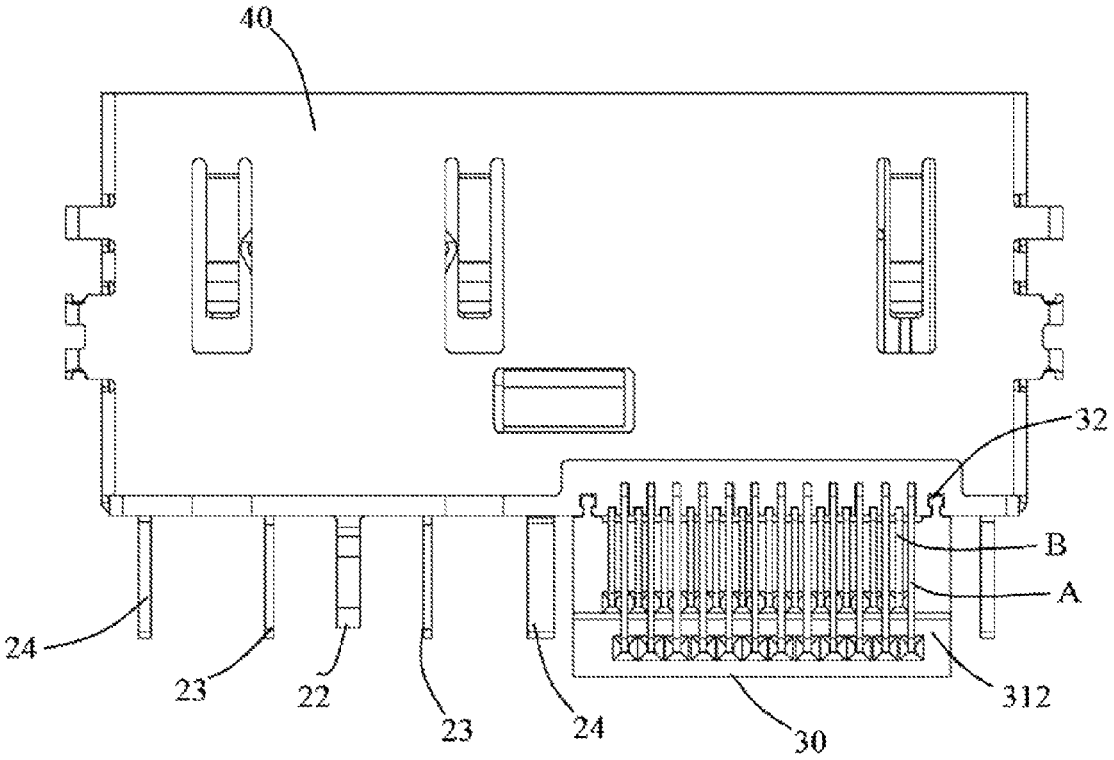
FIG. 5 is a bottom view of the electrical connector.

Said signal terminals 21 is divided into two groups which located on the top face and the bottom face of the horizontal portion 142 as a upper array and a lower array respectively. Said signal terminal 21 extends longitudinally and includes a contacting arm 211 receiving in said passageways 143, and a U-shaped tail 212 extending outwardly beyond the rear wall 130 from an end of said contacting arm 211. Said tail 212 is firmly retained in said spacer 30 which prevents the tail from moving during the process of soldering onto the PCB, therefore, the tails 212 can be soldered onto the soldering areas on the PCB. Moreover, in order to reduce the influence between said two arrays of signal terminals, the contacting arms 211 of said two arrays of signal terminals are configured in way of one-to-one correspondence while the tails 212 of said two arrays of signal terminals are arranged in a stagger way. As shown in FIG. 3, the tails 212 of said upper array B extend from a right side of the contacting arms 211 while the tails 212 of said lower array A extend from a left side of the contacting arm 211, as a result, there is enough space for the lower array A to be installed into the insulative housing 10 even after the upper array B been installed, the tails of the two arrays may not influence each other during the installation process which improves the efficiency of installation and reduces the cost.

Said detecting terminal 22 is received in said rectangular mating hole 151 of the second mating part 15. And the power terminal 23 is received in said receiving groove 153 on two sides of second mating part 15 and located between said stiffening ribs 154 which are used for stopping moving. Said ground terminals 24 are retained on an inner surface of the sidewalls 13 of the insulative housing 10, furthermore, in order to improve the grounding effect and avoid impact between the first mating part 14 and the second mating part 15, there is another ground terminal 24 retained between said first mating part 14 and second mating part 15, as referring to FIG. 2 and FIG. 4, this ground terminal 24 is received in a receiving slot 144 which is formed on a lateral surface of the first mating part 14. All detecting terminal 22, the power terminal 23 and the ground terminal 24 has a U-shaped leg 25 for mounting onto a PCB. Specially, said detecting terminal 22 includes a pair of mating beams 221 which is fork-shaped and retained in said lateral channels 155.

Figure 6:
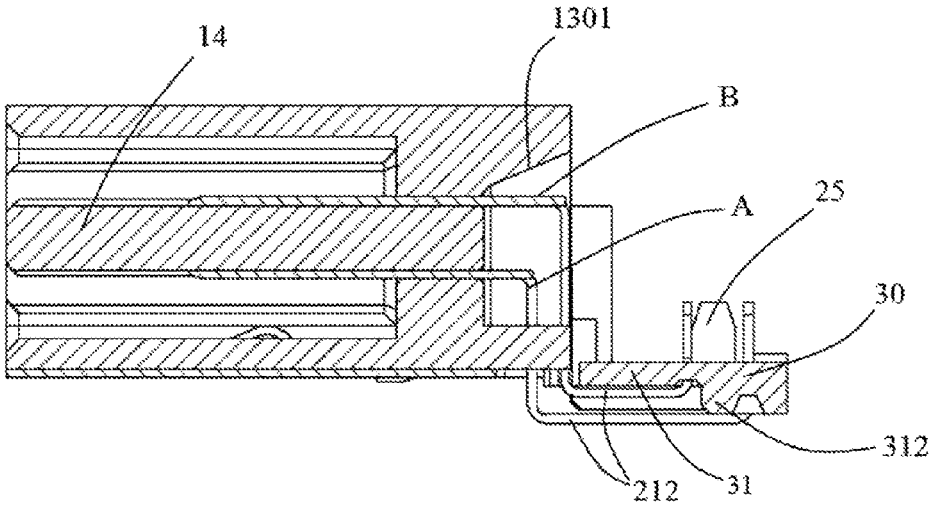
FIG. 6 is another section view of the electrical connector.
Figure 7:
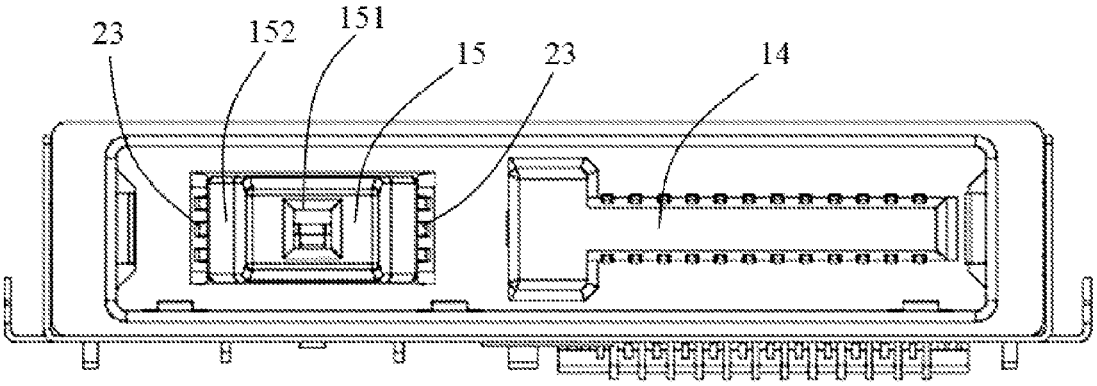
FIG. 7 is front view of the electrical connector.
Figure 8:
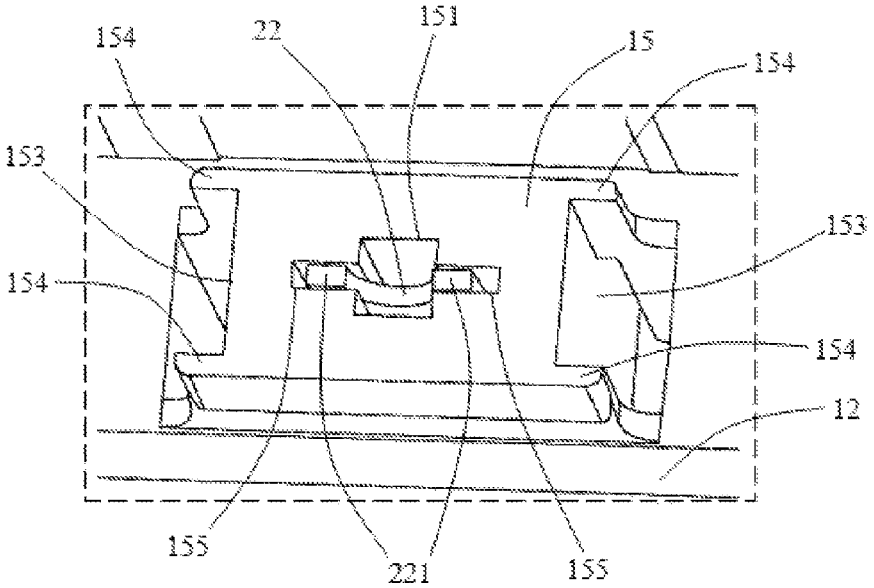
FIG. 8 is a partial cross section view of a second mating portion of the electrical connector.
Figure 9:
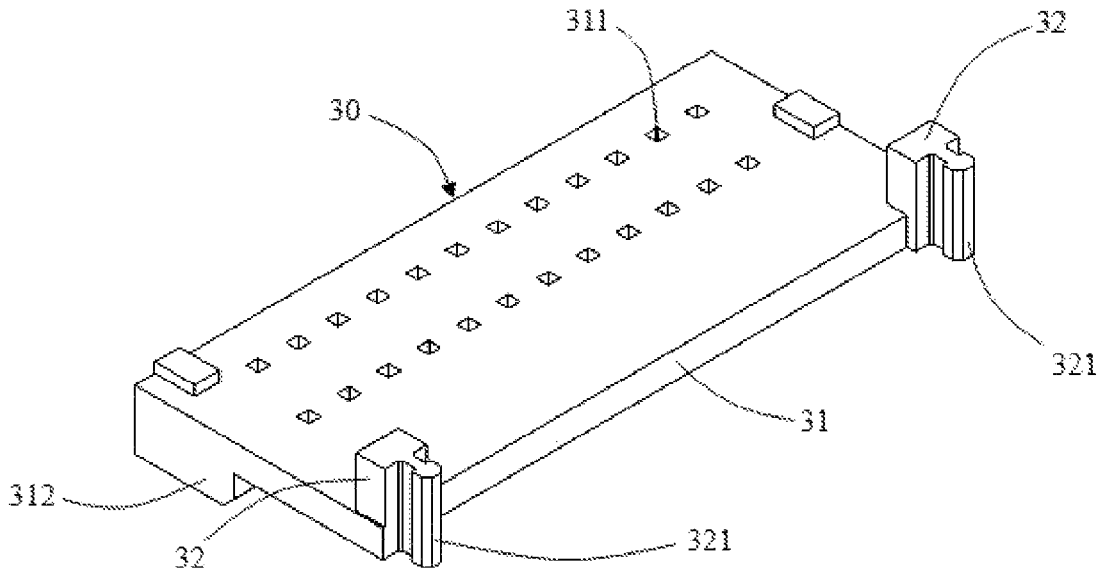
FIG. 9 is a perspective view of the spacer of the electrical connector.

As shown in FIG. 9, said spacer 30 is plate-shaped and includes a horizontal base plate 31 and a pair of locking posts 32 formed on a lateral side of the base plate 31. Said base plate 31 is a rectangular plate with a plurality of retaining holes 311 formed thereon for receiving the tails 212 of said signal terminals 21. Moreover, said base plate 31 further includes a step portion 312 on a bottom side for stopping against the tails 212 of the lower array signal terminals 21, as shown in FIG. 6, so that the U-shaped tails 212 of the lower array signal terminals 21 can be firmly retained along vertical direction. Furthermore, the step portion 312 also detaches the tails 212 of said upper array and lower array away from each other, which reduces the cross-talk influence therebetween. Said locking post 32 extends vertically from a top surface the base plate 31 for engaging with said fixing slot 1302 so that the spacer 30 can be firmly retained along a horizontal direction. Said locking post 32 has a protruding strip 321 engaging into said fixing slot 1302. As a result, after the U-shaped tails 212 leans against said step portion 312, the locking post 32 engages with said fixing slot 1302, the spacer is stopped from moving horizontally and vertically.

Said shell 40 covers on said insulative housing 10 and includes a retaining portion 41 retained into said retaining slots 131 of sidewalls 13, a soldering portion 42 mounted onto the PCB and a pair of bended tabs 43. Said bended tabs 43 are inwardly bended and extending into the engaging slots 132 of the sidewalls 13 to contact with said ground terminals 24.

The electrical connector of the present invention provides a new type second mating part 15 with two lateral guiding surfaces 152 and a spacer 30. Said second mating part 15 makes the insertion smoothly even in a wrong inserting direction, so the second mating part 15 may not be damaged easily. Moreover, the spacer 30 can firmly hold the tails of the terminals and engage with the insulative housing 10 by the locking post 32, the structure of the spacer 30 is simple which can reduce the cost and make the installation convenient.

Although embodiments have been fully described with reference to the accompanying drawings, it is to be noted that various changes and modifications will become apparent to those skilled in the art. Such changes and modifications are to be understood as being included within the scope of the various embodiments as defined by the appended claims.

What is claimed is:

1. An electrical connector, comprising:

an insulative housing having two sidewalls, a mating room between said two sidewalls and a mating part received in said mating room, said mating part defining a mating hole and a pair of receiving grooves extending rearward on two lateral sides of said mating hole;

a plurality of terminals retained in said insulative housing and including a detecting terminal received in said mating hole, two ground terminals retained on said sidewalls and a pair of power terminals received in said receiving grooves;

wherein said mating part further defines a pair of guiding surfaces on two sides of said mating hole and a pair of stiffening ribs on two sides of each receiving groove, said stiffening ribs are respectively formed on a top side and a bottom side of said receiving groove to stop said power terminal from moving vertically;

wherein said mating part is rectangular-shaped with a horizontal H-shaped cross section which is received in said mating room, said mating hole is located in the middle of said mating part, said horizontal H-shaped cross section is defined by two pairs of said stiffening ribs and one pair of said receiving grooves, and two pairs of said stiffening ribs extend horizontally from a top surface and a bottom surface of said mating part.

2. The electrical connector according to claim 1, wherein there are two lateral channels on two sides of said mating hole, said lateral channels connect with the mating hole to define a cross shape.

3. The electrical connector according to claim 2, wherein said electrical connector further includes a shell covered on said insulative housing, said shell has a pair of bended tabs contacting with said ground terminals, said bended tabs are 180-degree bended from a rear side of the shell for engaging with the insulative housing.

4. An electrical connector, comprising:

an insulative housing having a mating room, a T-shaped first mating part and a second mating part which are both received in said mating room, said first mating part including a vertical portion and a horizontal portion, said second mating part having a mating hole;

a plurality of terminals retained in said insulative housing;

a shell covering on said insulative housing;

a spacer engaged with said insulative housing;

wherein said second mating part has a pair of slanted guiding surfaces on two sides of said mating hole, a pair of receiving grooves behind said slanted guiding surface and a pair of stiffening ribs respectively formed on a top side and a bottom side of said receiving groove;

wherein said first mating part defines a receiving slot on a lateral surface of said vertical portion, said insulative housing has a top wall, a bottom wall, a pair of sidewalls and a rear wall, there is an engaging slot and a retaining slot respectively formed on an inner surface and an outer surface of said sidewall, said rear wall has a notch for receiving said terminals and a fixing slot on two sides of said notch for engaging with said spacer, said fixing slot is vertically extending and having a wider upper part and a narrower lower part which defines a T shape.

5. The electrical connector according to claim 4, wherein said terminals include a plurality of signal terminals retained on said horizontal portion, a fork-shaped detecting terminal received in said second mating part, a pair of power terminals and several ground terminals; said ground terminals are respectively retained in said engaging slot of the sidewalls and receiving slot of the first mating part.

6. The electrical connector according to claim 5, wherein said spacer includes a horizontal base plate and a pair of locking posts formed on a lateral side of the base plate.

7. The electrical connector according to claim 6, wherein said signal terminal has a U-shaped tail leaning against a step portion which is formed on a bottom side of said base plate; said locking post is formed on a top side of said base plate and has a protruding strip engaged with said fixing slot.

8. The electrical connector according to claim 7, wherein said second mating part is rectangular-shaped with a horizontal H-shaped cross section, said mating hole is located in the middle of said second mating part, said stiffening ribs extend horizontally from a top surface and a bottom surface of said second mating part.

9. The electrical connector according to claim 8, wherein said shell has a pair of bended tabs which are 180-degree bended from a rear side of the shell and extending into the engaging slots to contact with said ground terminals.

* * * * *